US006662556B2

(12) United States Patent
Bares et al.

(10) Patent No.: US 6,662,556 B2
(45) Date of Patent: Dec. 16, 2003

(54) HYDRAULIC SYSTEMS FOR A SMALL LOADER

(75) Inventors: Mark F. Bares, Oakes, ND (US); James H. Page, Bottineau, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 10/084,397

(22) Filed: Feb. 25, 2002

(65) Prior Publication Data

US 2003/0089002 A1 May 15, 2003

Related U.S. Application Data

(60) Provisional application No. 60/335,161, filed on Nov. 15, 2001.

(51) Int. Cl.[7] ..... F15B 11/16

(52) U.S. Cl. ..... 60/422; 60/424; 180/6.48

(58) Field of Search ..... 60/420, 421, 422, 60/424; 180/6.48, 19.3; 414/694

(56) References Cited

U.S. PATENT DOCUMENTS

| | | | | | |
|---|---|---|---|---|---|
| 3,583,585 | A | * | 6/1971 | Joyce | 414/694 |
| 3,916,767 | A | * | 11/1975 | Barton | 60/484 |
| 3,960,284 | A | * | 6/1976 | Carpenter | 60/421 |
| 4,343,151 | A | * | 8/1982 | Lorimor | 60/424 |
| 6,460,640 | B1 | | 10/2002 | Keagle et al. | 180/19.3 |

OTHER PUBLICATIONS

Toro Dingo Service Manual pp. 6–19 through 6–23—Published Prior to Nov. 15, 2000.

Brochure—Toro Dingo—So What's On This Weekend's Agenda—(4 pages) Published prior to Nov. 15, 2000.

* cited by examiner

*Primary Examiner*—Edward K. Look
*Assistant Examiner*—Thomas E. Lazo
(74) *Attorney, Agent, or Firm*—Westman, Champlin & Kelly, P.A.

(57) ABSTRACT

A small self-propelled loader has hydraulic drive motors and at least one work cylinder, and has a hydraulic system that efficiently utilizes the available horse power from an internal combustion engine on the loader. The engine drives a tandem pump and the flows from two sections of the tandem pump pass through a first diverter valve that permits using the flow from each of the pump sections to drive a respective one of the drive motors. The return or drain flow from valves controlling the drive motors is connected to a second diverter valve to selectively direct the drain flow from the drive motors for operating remote work cylinders. Alternately, the first diverter valve directs the output from one pump section to the work cylinders, so that when the loader is standing still or moving very slowly, the work cylinder has adequate flow, and flow from the other pump section is split to power the drive motors. The motors and work cylinders are connected to separate relief valves so that a higher working pressure is available for the drive motors.

20 Claims, 5 Drawing Sheets

HYDRAULIC SYSTEMS FOR A SMALL LOADER

This application refers to and priority is claimed from U.S. Provisional Patent Application Ser. No. 60/335,161 filed Nov. 15, 2001, the content of which is incorporated by reference in its entirety.

BACKGROUND OF THE INVENTION

The present invention relates to a small self-propelled loader which has hydraulically powered drive and work elements, connected in a hydraulic system to provide desired operational functions utilizing the available horsepower efficiently. The engines on small loaders are also relatively low horsepower, and by using the hydraulic power available efficiently, various tasks can be carried out at the same time that the loader can be moved or driven at an appropriate speed.

Various small loaders have been advanced, and these usually do use an internal combustion engine with hydraulic drives for the propulsion system, as well as hydraulic cylinders for moving loader arms and driving attachments or accessories. These loaders generally do not have an operator's compartment, but the operator will stand on a platform, or on the ground, adjacent to controls at the rear of the loader. In order to efficiently use available power, it is desirable to have the full flow of hydraulic pumps available for propelling the vehicle at times, and at other times it is desirable to use a high pressure for accessories while permitting the vehicle to creep at a slow speed, for example when operating a trencher. The present hydraulic system is connected using standard components to achieve the desired results.

SUMMARY OF THE INVENTION

The present invention relates to a hydraulic system for a small loader, as shown a track driven loader propelled by hydraulic motors. The internal combustion engine that is used is maintained at a small size and horsepower output based on the tasks involved. The loader is completely hydraulically driven and operated.

The loader of the present invention uses tandem gear pumps that can be controlled in various modes of operation. When maximum travel speed is desired, separate pump sections are connected to drive the hydraulic motors on the opposite sides of the loader or vehicle, so that each of the motors is receiving the full flow from one of the pump sections or separate pump.

A circuit is provided for carrying the flow of hydraulic fluid under pressure beyond the motors in one mode. The motor valves have a flow through center position where the flow enters a common drain line. The return side of the motors is also connected to the common line leading to a diverter valve and then to a work motor group valve, such as hydraulic lift cylinders for loader arms, a tilt cylinder for a loader bucket, and to auxiliary connections for driving hydraulic motors or actuators on attachments that are used with the loader. Excess flow then is returned to the reservoir or tank, after it has been passed through the necessary valves for controlling the work motor components.

Additionally, the hydraulic circuit is made so that when it is desired to direct the flow from the pumps primarily to work group motors, for example when the loader may be standing still or as will be explained when it is to move only at a very low or "creep" speed, the diverter valve can be operated to direct the primary flow from the pumps to the work group valve, so that substantially the full output of one pump, and, if desired, part of the output from the other pump can be used for operating work motors such as the loader lift cylinders or actuators, the tilt cylinder, or some rotary motors for auxiliary equipment connected through quick couplers that connect hydraulic components on attachments to lines on the loader.

The hydraulic system includes a flow control valve that is manually adjustable when the diverter valve is directing the major flow from the pump sections to the work group valve to permit a controlled amount of hydraulic fluid under pressure from one pump section to be divided and supplied to the valves for the drive or travel motors. The low, controlled flow to the respective drive motors permits a "creep" movement while the majority of the flow powers an attachment motor, such as a trencher or other component that requires some forward motion of the loader at the same time that the auxiliary attachment is working.

The hydraulic system provides efficiency of operation based on the available power.

DETAILED DESCRIPTION OF THE PREFERRED EMBODIMENTS

Figure 1:
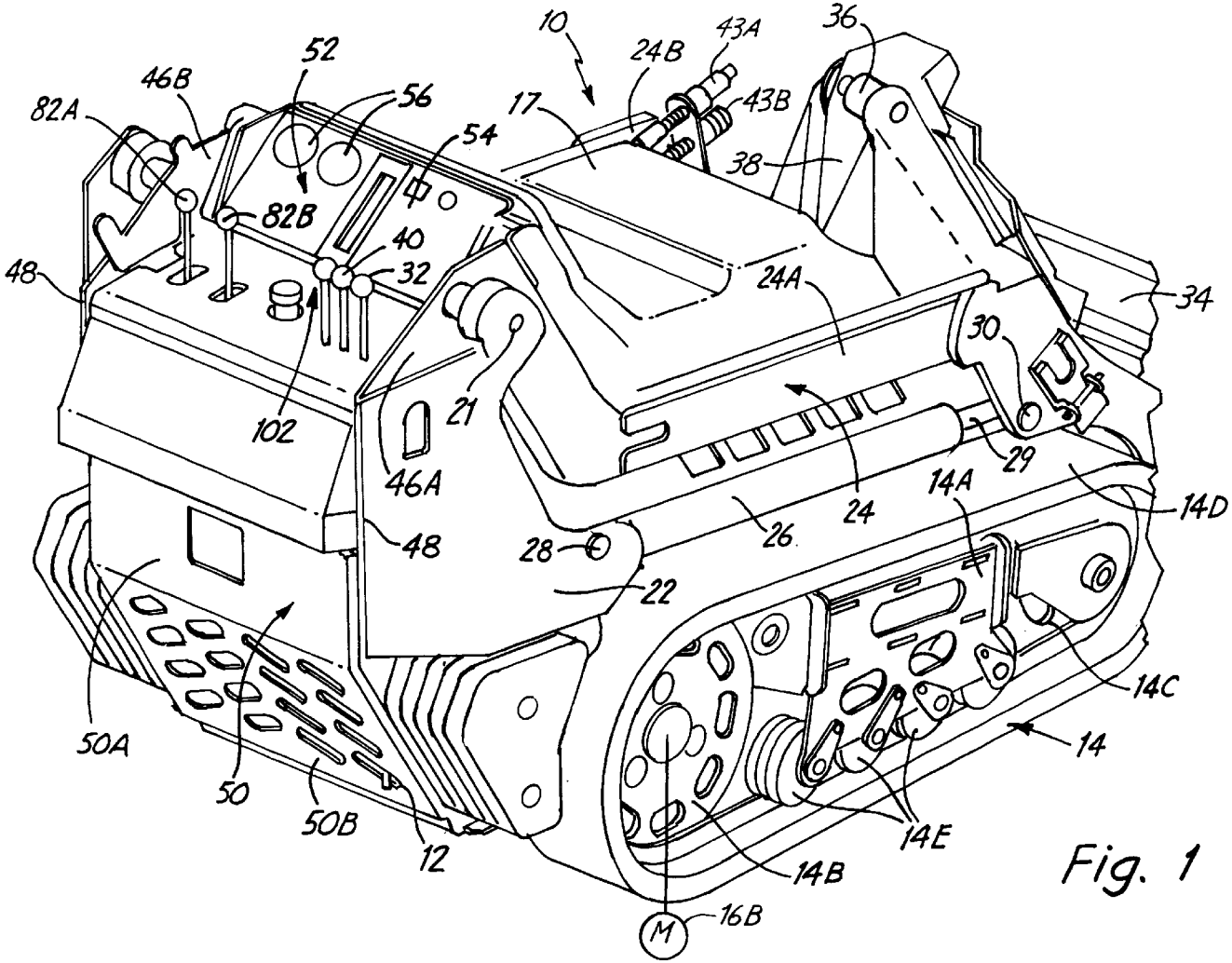
FIG. 1 is a perspective view of a small loader having a hydraulic system made according to the present invention installed thereon.

Referring to FIG. 1, a small skid steer loader indicated generally at 10 is shown as a walk behind powered loader that has a body or frame 12. The frame 12 supports a track assembly 14 on each side of the loader for propelling the loader in forward and reverse directions through the use of drive hydraulic motors 16A and 16B. Drive motors 16A and 16B are hydraulic motors operated from a pump assembly 18, that includes two gear hydraulic pumps 18A and 18B, which are driven by an internal combustion engine 20 mounted on the body or frame 12 in a housing 17. Other hydraulic motors and pumps can be used.

Each track assembly 14 includes a track frame 14A, a drive sprocket 14B, and a front idler wheel 14C over which a track 14D is mounted. Bogie wheels 14E are also provided on the track frame 14A for support of the track.

The loader body or frame 12 has upright supports 22 at the rear of the frame and these supports 22 extend upwardly a little higher than waist level of an operator standing on the ground. The upright supports in turn pivotally support base or rear ends of a lift arm assembly 24 on pivots 21. Lift arm assembly 24 includes individual lift arms 24A and 24B on opposite sides of the body or frame 12. Lift arm assembly 24 is raised and lowered with extendible and retractable double acting hydraulic motors, in the form of cylinders or actuators 26, operating with hydraulic pressure from the pumps 18A and 18B, as will be explained, and controlled by suitable valves, as will be explained. The valves are part of a work valve assembly that forms part of the overall controls for the loader or other machine.

The hydraulic lift cylinders 26 (there is one cylinder on each side of the frame, and only one is shown in FIG. 1) have base ends pivotally mounted as at 28 to the body or frame 12, and the cylinders have extendible and retractable rods 29 that have rod ends that are pivotally mounted as at 30 to each respective lift arm of the lift arm assembly 24. Lift arm assembly 24 has a bucket 34 at the front end, mounted on the lift arms, and controlled by a bucket control hydraulic motor, in the form of a tilt cylinder or actuator 36. Tilt cylinder 36 has its base end connected to an upright strut 38 on the lift arm assembly. The bucket tilt cylinder also is operated through suitable work valves, as will be shown in the hydraulic schematic portion of the description.

An operator's station shown at 52 is at about waist level with an operator, and various hydraulic control valve handles are provided at the station. The operator stands at the rear of the loader, and can operate the drive motors, the lift arms, the bucket, and any powered attachment or accessories. It should be noted that motors on attachments or accessories can be connected to hydraulic lines that are controlled by a valve as will be explained, and which are connected to lines from the valve through quick couplers shown at 43A and 43B, respectively.

Figure 2:
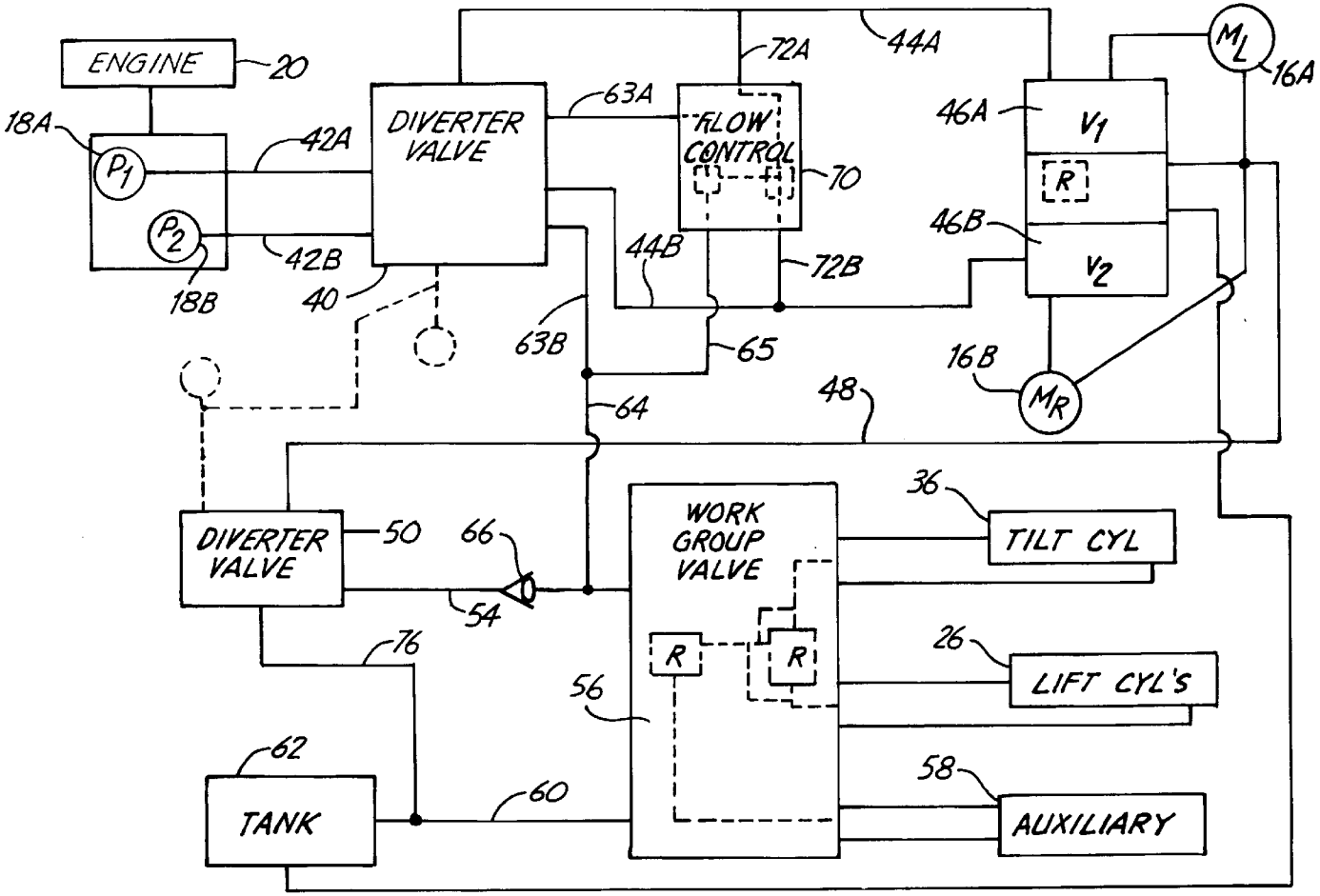
FIG. 2 is a schematic block diagram of the hydraulic system of the present invention.

Referring to FIG. 2, a block diagram representation of the hydraulic system for the loader is provided. In FIG. 2, the engine 20 is driving the pump assembly 18, which includes individual gear pumps or pump sections 18A and 18B. A first diverter valve 40 is a spool type valve, which has ports for receiving the flow from the pumps 18A and 18B, individually along lines 42A and 42B. In one position of the diverter valve 40 flow is provided through output ports and lines 44A and 44B to a valve block having first and second drive or traction motor control valves shown in block diagram form at 46A and 46B.

The valves 46A and 46B are used for controlling flow to the drive motors 16A and 16B, respectively, that in turn drive sprockets 14B and the tracks 14D. The valves 46A and 46B have a center through flow position where the drive motors are not powered, and in this position the flow passes to a line 48. The return flow from each of the motors, that is the low pressure side, is also provided to line 48 that is termed a "power beyond line" or common drain line. Line 48 carries the flow from the drive motors and/or valves 46A and 46B and will provide this flow to various other work motors or components on the loader.

The line 48 is connected to a second diverter valve 50 the spool of which is mechanically coupled to the diverter valve 40 so that the two diverter valves 40 and 50 are simultaneously operated by an operator moving a control handle. When the valve 40 is set to direct flow into the individual lines 44A and 44B and thus to the diverter valve 50 will provide the flow from line 48 to an output line 54 and to a work group valve block 56.

The work group valve block 56 has individual manually controllable 4-way valves connected to motors including the lift cylinders 26, tilt cylinder 36 and when needed to motors 58 for auxiliary equipment or attachments. The work group valve block 56 is arranged so that separate relief valves are provided for controlling maximum pressure of the lift and tilt cylinders, which is separately relieved from a relief valve for the overall work group valve which when it is separately used and not in series with the line 48, as will be explained, will provide a much higher pressure to the motor for auxiliary equipment 58. A line 60 leads from the work group valve to a hydraulic tank 62.

As will be more fully shown, when movement of the loader is stopped or is to be very slow, arrangement is made so that the flow from the one of the hydraulic pumps 18A and 18B and partial flow from the other is diverted to the work group valve 56, in particular for running auxiliary equipment represented at 58.

A shift position of the diverter valve 40, and the simultaneously operated diverter valve 50 (these are tied together so they operate at the same time) will cause the flow from one pump to be diverted to the work group valve 56 along with at least some flow from the other pump.

In the alternate position of diverter valves 40 and 50, pump 18A provides flow to flow control valve assembly 70 and pump 18B provides flow along line 63B. Flow control valve assembly 70 has a manually adjustable flow control valve internally that can be closed to divert all of the flow from pump 18A out a line 65 which connects to line 64 or opened to provide for a portion or most of the flow from the line 63A to go through a flow splitter 71A, 71B and into lines 72A and 72B which connect to the lines 44A and 44B leading to the valves 46A and 46B. The flow from lines 72A and 72B is then available for use for driving the drive motors 16A and 16B.

The flown control valve 70A can be adjusted so that the loader will only "creep" along a very slow rate. In this alternate position of the diverter valves, flow through from the motors then connects to line 48, and diverter valve 50, when shifted, directs this low flow from the motors 16A and 16B or through the flow from the motor valve through a line 76 to the reservoir or tank 62.

Both lines 63B and 65 connect to a line 64 that tees into the line 54 to the work group valve so all or most of the pump flow is available for auxiliary equipment. A check valve 66 (FIG. 3) prevents back flow through diverter valve 50.

Figure 3A:
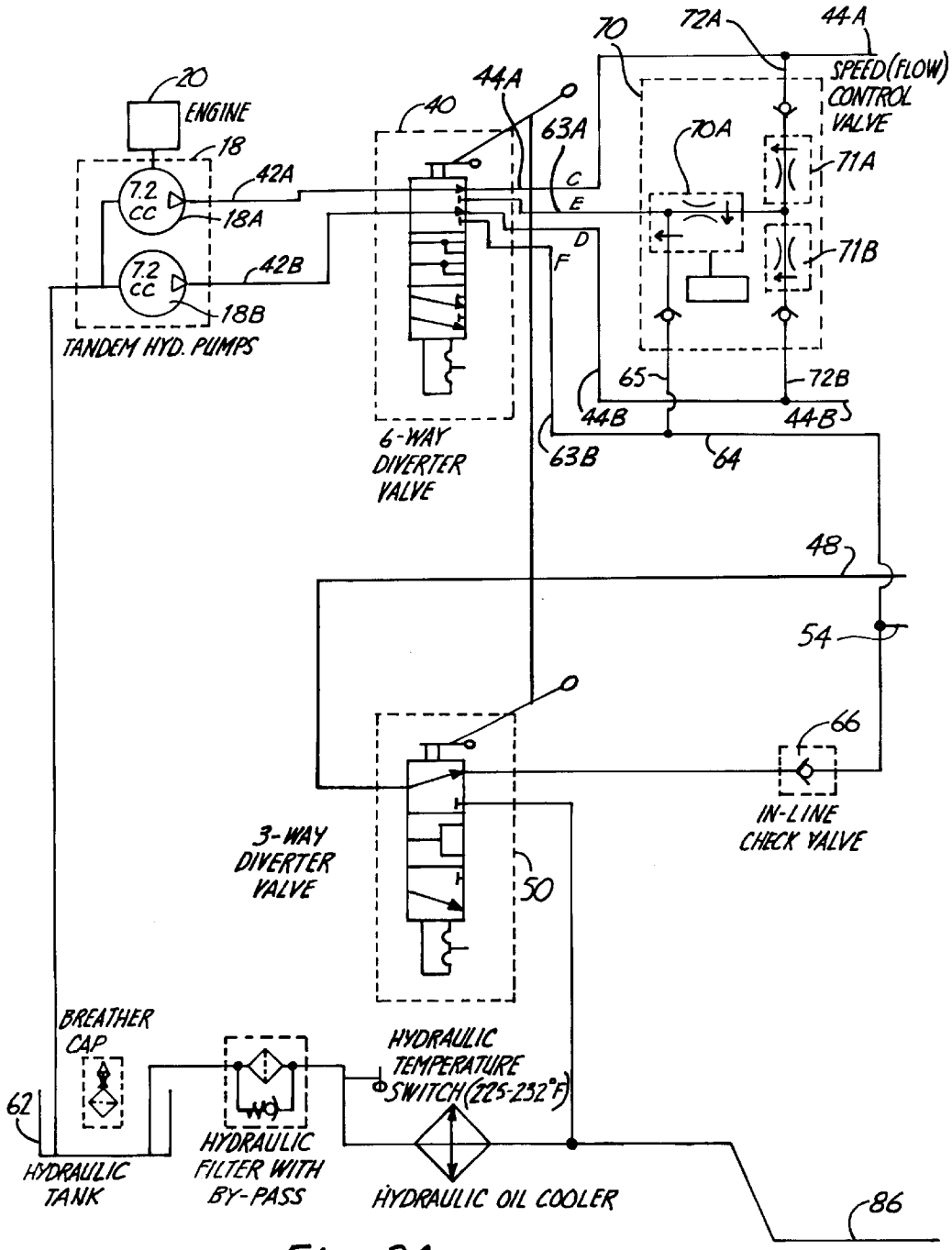
FIG. 3A is a first portion of a schematic drawing of the hydraulic system of the present invention.
Figure 3B:
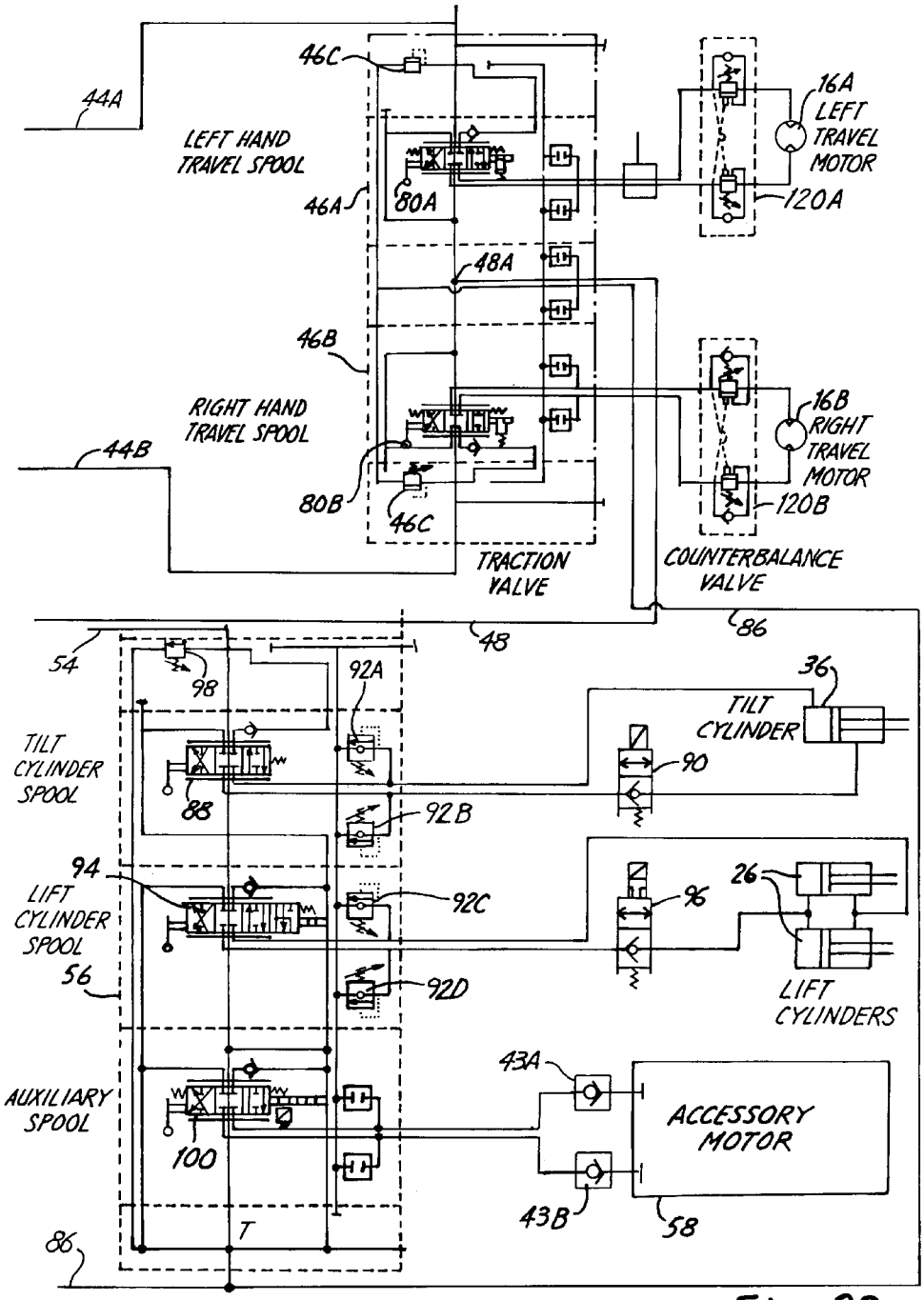
FIG. 3B is a second portion of the schematic drawing of the hydraulic system and mating with FIG. 3A.

In FIGS. 3A and 3B, similar numbering is used as in FIG. 2, but more detail is provided in relation to the use of different relief valves for the different functions. The engine 20 is illustrated along with the pump assembly 18, and individual pumps or pump sections 18A and 18B. These pumps provide for flow along the lines 42A and 42B to the first diverter valve assembly 40. The diverter valve 40 is a spool type valve that is essentially a 6-way diverter valve, and in the diverter valve position shown in FIG. 3A, it can be seen that the line 42A is connected to the line 44A and line 42EB is connected to the line 44B. These lines lead directly to the valve block 46 that contains drive motor control valves 46A and 46B, respectively. The valves 46A and 46B are spool valves that are controlled through the use of handles 80A and 80B, which are shown schematically in FIG. 1. These spool valves are made so that they can provide a proportional flow to the travel motors based on displacement of the valve spools. The spools are reversible so that the motors 16A and 16B can be reversed in rotation. Again, the speed is controlled by displacing the spools from a central position, and the amount of movement will determine the speed of travel.

Each of the valves 46A and 46B has a separate relief valve for the motors as shown at 46C and 46D, respectively. These valves are set at a high pressure, for example 2800 psi or 193 bar. These are the highest pressure relief valves in the system. In part this is because the power beyond line 48, which is connected to the valves 46A and 46B at a common terminal as shown at 48A, carries pressure to the work group valve and to actuators and auxiliary equipment in series so that pressure in the work group with diverter valves 40 and 50 in their first positions will add to the pressure at the travel motors 16A and 16B. The higher pressure is thus necessary because of the series fluid pressure connection. When the relief valves 46A and 46B open, they will dump flow into a return line 86 that leads to tank 62. The flow from both of the pumps or pump sections 18A and 18B is about 14 gallons per minute. In this first position of valve 50, the flow goes to the line 54 and through check valve 66 to work group valve 56. The line 54 is connected to the pressure side of work group valve 56.

Work group valve 56 includes a work spool valve 88 that is used for controlling the tilt cylinder 36. A tilt lockout solenoid valve 90 is illustrated in the circuit and can be provided, if desired. The pressure and return lines from the tilt cylinder have relief valves 92A and 92B respectively that are set at about 1400 psi or 96.5 bar, which is a lower pressure than that of valves 46A and 46B, but adequate for operating this cylinder.

A work spool valve 94 is used for controlling the lift cylinders 26, and again a solenoid lockout valve 96 is used in the line to the base of the lift cylinders. Suitable relief valves 92C and 92D, which are set at the same pressure as valves 92A and 92B are connected into the lines for the lift cylinders 26 as well. As can be seen, the lift cylinders 26 are connected in parallel, and the lockout solenoid valves 90 and 96 are on the pressure sides of the respective cylinders when the cylinder is being used to lift the bucket.

A main relief valve 98 in the work group valve block 56 is set at a higher pressure, for example 2500 psi or 175 bar and is the relief pressure setting for the auxiliary equipment represented at 58.

The auxiliary equipment is operated through a spool valve 100, that is controlled by a valve control handle such as those shown at 102 generally in FIG. 1.

The relief pressure for the valve 100, and thus for the auxiliary equipment, is from relief valve 98, which is set high enough for operation of motors on trenchers or diggers when those machines are the auxiliary equipment or attachment.

The 6-way diverter valve 40, as shown, will provide flow along line 63A and along the lines 63B and 64 when the diverter valve 40 is shifted to connect the input ports A and B shown in FIG. 3A to ports E and F on the 6-way diverter valve 40. The adjustable orifice or flow control valve shown at 70A in valve 70 can be manually closed with a handle 70H and all flow along line 63A will be diverted to line 65.

The adjustable orifice or valve 70 can be manually controlled for providing a limited or partial flow from line 63A to a pair of flow splitter valves 71A and 71B, respectively, that will divide the flow from adjustable orifice or valve 70A so that it will be provided along lines 72A and 72B to lever 44A and 44B and then to the respective valves 46A and 46B. This, again, provides for a major portion of the flow to go to the work group valves along line 64, and in particular to the attachment 58.

If the attachment 58 is a trencher or a digger where there should be movement of the loader, the creep speed control for permitting the vehicle or loader to creep slowly is obtained by adjusting the variable orifice of the flow control valve 70A. In effect, the present hydraulic system provides for two circuits in one. In one mode, one pump will supply a valve for one of the drive motors, and the other pump will provide flow to the valve for the other drive motor. Speed, again, is controlled by moving the spools in valves 46A and 46B, so that the flow can be from zero to full flow, and all of the excess flow will go out through the power beyond or common drain line 48, along with the return flow from the motors.

In the second mode, the diverter valves 40 and 50 are shifted so that the work group, including the attachment motor lines and connection or couplers 43A and 43B or work cylinders will be provided with high flow, and the pressure available for work motors, such as cylinders or attachments will be controlled by relief valve 98. The arrangement permits the use of gear pumps in tandem, for providing a hydraulic fluid under pressure.

When the work cylinders are provided with flow from common drain line 48 the pressures from the work cylinders and the drive motors are in series or additive. Thus pressure at relief valve 46C is additive with pressures from the work cylinders and drive motors. There are times when the work cylinders are loaded and the drive motors are used, that the setting of relief valve 46C will be exceeded.

In the second position of the diverter valves 40 and 50 the relief valves 46C and 98 no longer are in series and the pressures are no longer additive. The relief valves 46C and 98 will operate independently, so the pressures at the drive motors and work cylinders are capable of providing independent operating pressures to the respective work members or motors.

Figure 4:
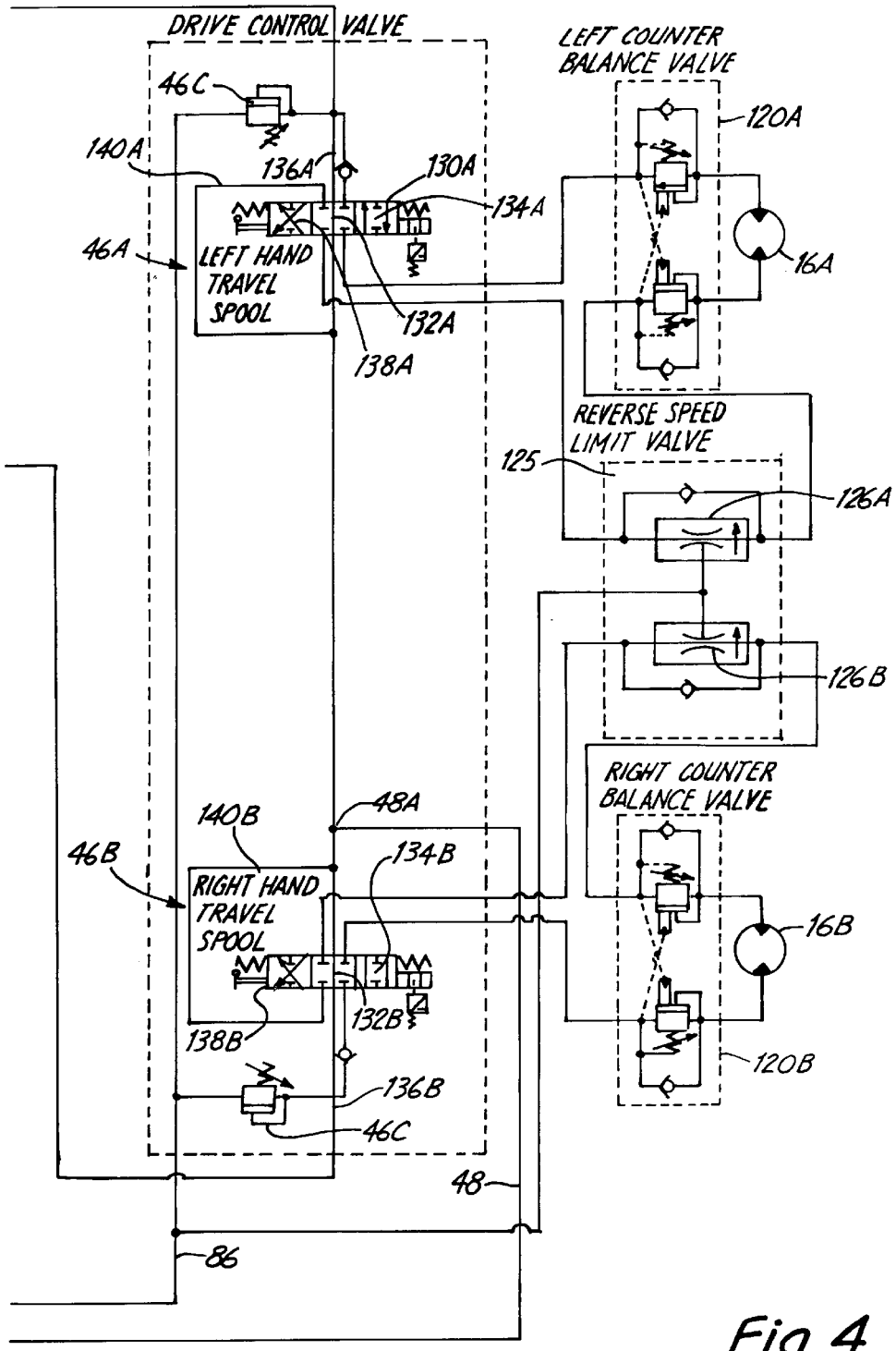
FIG. 4 is a more detailed schematic showing a reverse speed limit valve in the motor circuits.

As shown in FIGS. 3B and 4, each of the motors has a counterbalance valve indicated at 120A and 120B. These valves are used in the motor circuit, so that the respective motor will be locked unless the valve spool is being operated, and there is pressure being supplied to one side of the motor or the other.

It also should be noted that in FIG. 4, the drive motors 16A and 16B are connected into a reverse speed limit valve 125, which will limit the speed of the loader in reverse by passing the flow through a selected orifice 126A and 126B, respectively that can be adjusted. Bypass check valves are provided for flow when the motors are being driven in the forward direction, as can be seen. The reverse flow control then does limit only the reverse speed of the loader.

The valves 46A and 46B are shown in greater detail in FIG. 4 as well, and the valve 46A, which is the left-hand travel or drive motor control spool, has a spool assembly shown at 130A that provides for a center flow through passageway 132 when the valve is in its neutral position, and there is no flow to the left motor. This central flow passageway 132A is connected to the junction 48A, previously shown, which in turn is connected to the power beyond or common drain line 48 that leads back to the diverter valve 50 or to drain.

In the valve position where the motor would be driven in a forward direction, it can be seen at 134A that the valve spool will block flow through the inflow line shown at 136A, to the junction 48A, and when the spool is moved in an opposite direction, which is the reverse side as shown at 138A, the flow from the line 136 to junction 48A is closed as well, but in those positions and condition of drive the flow is to the respective motor and the return flow through the valve is connected to the lines shown at 140A that is connected to the junction 48A to provide for the common flow into the line 48.

In the right-hand travel spool 46B, the same connections are shown, but are numbered with the "B" designation. In the neutral position, there is a flow through to the junction 48A with connection passageway 132B, and the bypass line 140B is connected again to provide for the return flow from the motor back to the junction 48A and line 48. The high pressure relief valves, both designated 46C, are also shown in FIG. 4.

The line to tank 86 is shown in FIG. 4 as well, as are the motors 16A and 16B.

Thus, the full functions of the walk behind small loader are achieved with a hydraulic system that utilizes the power available efficiently, and in particular provides for differential flows to the drive motors to accommodate different operating conditions and desires. The relief valve settings are made so that they will be operated in series when the work group motors or work group valves are not requiring high pressures and flows, but that travel across the ground is to be maximized. The system will permit diverting flow from one pump or pump section to the work group valves, at which time the work group valves are provided with a high pressure output so that attachment motors connected to the quick couplers that are provided can be operated at high pressures for tasks such as trenching or digging.

It should also be noted that an operator platform can be provided at the rear of the loader, if desired, and folded out of the way for making a walk behind unit. This way the operational features are enhanced, and in particular, if the loader is to be moved for some distance, the operator can stand rather than walk.

Although the present invention has been described with reference to preferred embodiments, workers skilled in the art will recognize that changes may be made in form and detail without departing from the spirit and scope of the invention.

What is claimed is:

1. A hydraulic system for a power machine having a frame;

a drive motor for propelling the machine;

at least one work cylinder operated under hydraulic pressure;

a pump assembly;

a motor control valve connected to said pump assembly to receive flow from said pump assembly and operable to drive the motor, the motor control valve having a center flow through position, and at least a forward drive position for the motor;

a common drain line from the motor control valve to carry the flow from the motor control valve in the center flow through position and connected to receive return flow from the motor; and a diverter valve connected to selectively divert the flow from the common drain line to a cylinder control valve for controlling the work cylinder.

2. The hydraulic system of claim 1, wherein said diverter valve has a position to connect the flow carried by the common drain line from the motor control valve to a second drain line.

3. The hydraulic system of claim 2, wherein said pump assembly comprises two individual pump sections each providing a flow, the diverter valve comprising a first diverter valve, and a second diverter valve for receiving flow from both of said pump sections of the pump assembly and movable to a flow control position to direct at least a portion of the flow from the pump assembly to a separate line leading to the second diverter valve, the first diverter valve being connected to the second drain line when the second diverter valve is connected to the flow control position.

4. The hydraulic system of claim 1, wherein the drive motor comprises;

a first drive motor for drive elements on a first side of the frame;

a second drive motor for drive elements on a second side of the frame, the motor control valve comprising a first motor control valve;

a second motor control valve each valve controlling the respective motors, the diverter valve having a second position to direct the flow from one of the pump sections through a flow control valve, the flow control valve dividing the flow from the one pump section to provide substantially equal flow to each of the first and second motor control valves, and the second pump section then being connected to the cylinder control valve controlling the least one work cylinder.

5. The hydraulic system of claim 4, wherein said first and second motor control valves have first relief valves connected thereto to control the maximum pressure of fluid provided to the drive motors; and the cylinder control valve for controlling the at least one cylinder having a second separate relief valve, the first and second relief valves being fluidly independent of each other with the diverter valve in the second position.

6. A hydraulic system for a self propelled machine having a frame;

a hydraulic pump assembly having separate pump sections providing separate flows;

first and second hydraulic drive motors;

first and second motor control valves connected to operate the first and second hydraulic drive motors, respectively;

a power source on the frame for powering the pump assembly of the hydraulic system;

a diverter valve having a first position for receiving the individual flows from each of the pump sections and directing individual flow from the pump sections to one of the first and second motor control valves, respectively;

a flow divider; and said diverter valve being shiftable to a second position to direct the fluid flow from a first of the pump sections to a flow divider, the flow divider providing divided flow to both the first and second motor control valves, and the diverter valve providing flow from a second pump section directly to a work valve on the machine for operating at least one work cylinder.

7. The hydraulic system of claim 6, wherein said first and second motor control valves each have a first position wherein the flow passes through the valves to a common drain, a second position wherein the motor controlled by the respective valve is operated in a forward direction, and a third position wherein the motor controlled by the respective valve is operated in a reverse direction, a return flow from the motors passing to the common drain in each of the second and third positions of the motor control valves, a second diverter valve connected to the common drain and moveable to positions to selectively connect the common drain to a second drain line with the first diverter valve in its second position, and to connect the common drain line to the work valve, with the first diverter valve in its first position.

8. The hydraulic system of claim 7, wherein said first and second diverter valves are connected together, so that when said first diverter valve is moved to its second position, the second diverter valve substantially simultaneously directs flow from the common drain to the second drain line.

9. The hydraulic system of claim 7, and an adjustable flow restrictor between the first diverter valve and the flow divider to limit the flow of hydraulic fluid directed to the first and second motor control valves and thus to the motors, the flow restrictor being connected to add portions of flow therethrough to the flow from the second pump section and to the work valve.

10. A loader having a frame and drive motors on opposite sides of the frame, the drive motors being individually selectably drivable, and the loader having at least one work cylinder operated under hydraulic pressure;

a pump assembly;

first and second valves connected to said pump assembly to receive substantially equal flow from said pump assembly, said first and second valves being operably connected to control rotation of the drive motors, the first and second valves each having a center flow through position, and at least a forward drive position for each of the motors, respectively;

a common drain line from both of the first and second valves to carry the flow from the first and second valves in the center through flow positions and the common drain line being connected to receive return from both of the drive motors; and a diverter valve connected to selectively divert the flow from the common drain line to a third control valve for controlling the work cylinder.

11. The loader of claim 10, wherein said diverter valve has a position to connect the common drain line from the first and second valves to a second drain line.

12. The loader of claim 11, wherein said first and second diverter valves are simultaneously operated, so that when the second diverter valve is moved to direct flow from one of the pump sections through the flow control valve, the first diverter valve connects the common drain line from the first and second valves to the second drain line.

13. The loader of claim 10, wherein said pump assembly comprises two individual pump sections each providing a flow, the diverter valve receiving flow from both of said separate pump sections and selectively directing flow from each of the pump sections into a respective individual line to the first and second valves for controlling the drive motors and in an alternate position directing flow from one pump section to the at least one work cylinder and flow from the other pump section to a flow control valve connected to the motors and dividing the flow from the other pump section between the first and second valves.

14. The loader of claim 13, wherein the flow control valve divides the flow from the other pump section to provide substantially equal flow to each of the first and second valves.

15. The loader of claim 14, wherein said flow control valve has a flow restrictor connected thereto to divert a portion of the flow from the other pump section to the valve for controlling the at least one work cylinder.

16. The loader of claim 15, wherein said flow restrictor in said flow control valve is manually adjustable.

17. The loader of claim 10, wherein each of said first and second valves have a relief valve connected thereto to control the maximum pressure of fluid provided at the first drain line and the valve for controlling the at least one work cylinder having a separate relief valve set for opening at a lower pressure than the relief pressure of the first and second valves.

18. The loader of claim 17, wherein there are a plurality of work cylinders, and each of the work cylinders has an individual work valve, the relief valve for the one work cylinder being common to all of the valves for the plurality of work cylinders.

19. The loader of claim 10, wherein the first and second valves are movable to a reverse position to reverse the respective drive motor, and a separate flow restrictor connected to a drain line of each drive motor that limits flow through the drive motors when the respective drive motors are operated in reverse.

20. The loader of claim 10, wherein said pump assembly is connected to an internal combustion engine on the frame.

* * * * *

UNITED STATES PATENT AND TRADEMARK OFFICE

CERTIFICATE OF CORRECTION

PATENT NO. : 6,662,556 B2
DATED : December 16, 2003
INVENTOR(S) : Bares et al.

It is certified that error appears in the above-identified patent and that said Letters Patent is hereby corrected as shown below:

Title page,
Item [54], Title, change "SYSTEMS" to -- SYSTEM --.; and
after "FOR" delete "A".

Signed and Sealed this

Sixth Day of July, 2004

JON W. DUDAS
*Acting Director of the United States Patent and Trademark Office*